US005389509A

United States Patent [19]

Maskasky

[11] Patent Number: 5,389,509

[45] Date of Patent: Feb. 14, 1995

[54] ULTRATHIN HIGH CHLORIDE TABULAR GRAIN EMULSIONS

[75] Inventor: Joe E. Maskasky, Rochester, N.Y.

[73] Assignee: Eastman Kodak Company, Rochester, N.Y.

[21] Appl. No.: 130,978

[22] Filed: Oct. 4, 1993

[51] Int. Cl.[6] ..... G03C 1/015; G03C 1/035; G03C 1/07

[52] U.S. Cl. ..... 430/567; 430/569; 430/614; 430/615

[58] Field of Search ..... 430/567, 569, 614, 615

[56] References Cited

U.S. PATENT DOCUMENTS

| | | | |
|---|---|---|---|
| 4,672,027 | 6/1987 | Daubendiek et al. | 430/505 |
| 4,693,964 | 9/1987 | Daubendiek et al. | 430/505 |
| 5,176,991 | 1/1993 | Jones et al. | 430/569 |
| 5,178,997 | 1/1993 | Maskasky | 430/569 |
| 5,217,858 | 6/1993 | Maskasky | 430/567 |

*Primary Examiner*—Charles L. Bowers, Jr.
*Assistant Examiner*—Mark F. Huff
*Attorney, Agent, or Firm*—Carl O. Thomas

[57] ABSTRACT

A radiation sensitive emulsion is disclosed containing a silver halide grain population comprised of at least 50 mole percent chloride, based on silver, in which greater than 50 percent of the total grain projected area is accounted for by ultrathin tabular grains containing a 7-azaindole type compound.

13 Claims, No Drawings

ULTRATHIN HIGH CHLORIDE TABULAR GRAIN EMULSIONS

FIELD OF THE INVENTION

The invention relates to silver halide photography. More specifically, the invention relates to radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid develop-ability and the ecological advantages of high chloride emulsions have provided an impetus for employing these emulsions over a broader range of photographic applications. As employed herein the term "high chloride emulsion" refers to a silver halide emulsion containing at least 50 mole percent chloride, based on total silver.

During the 1980's a marked advance took place in silver halide photography based on the discovery that a wide range of photographic advantages, such as improved speed-granularity relationships, increased covering power both on an absolute basis and as a function of binder hardening, more rapid develop-ability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

The various photographic advantages were initially associated with achieving high aspect ratio tabular grain emulsions. As herein employed and as normally employed in the art, the term "high aspect ratio tabular grain emulsion" is defined as a photographic emulsion in which tabular grains having a thickness of less than 0.3 μm and an average aspect ratio of greater than 8 account for at least 50 percent of the total grain projected area of the emulsion. Aspect ratio is the ratio of tabular grain effective circular diameter (ECD) divided by tabular grain thickness (t).

In reviewing the various components of the high aspect ratio tabular grain emulsion definition it is apparent that the average aspect ratio of an emulsion can be raised by increasing the ECD of the tabular grains while maintaining tabular grain thicknesses up to the 0.3 μm limit. Once the practical value of tabular grain emulsions was appreciated, the average aspect ratios of the emulsions were soon raised by increasing tabular grain ECD's to their useful limits, based on acceptable levels of granularity. In fact, the earliest patents required the tabular grains to have an ECD of at least 0.6 μm. Thus, the most dramatic initial impact of high aspect ratio tabular grain emulsions was in high speed photographic applications—e.g., at or above 1000 ASA speed ratings.

It was subsequently recognized that the advantages of tabular grain emulsions were also significant at even moderate average aspect ratios. Moderate aspect ratio tabular grain emulsions are herein defined and normally recognized in the art to embrace photographic emulsions in which tabular grains having a thickness of less than 0.3 μm and an average aspect ratio of at least 5 account for at least 50 percent of the total grain projected area of the emulsion. At present tabular grain emulsions are recognized to include average aspect ratios as low as 2.

A difficult to achieve improvement was realized by increasing the percentage of the total grain projected area accounted for by the tabular grain population. This required developing a better understanding and control of the conditions under which tabular grains were formed, particularly the conditions of nucleation and twin plane formation. Gradually the capability of precipitating emulsions with the desired tabular grain population accounting for much more than 90 percent of the total grain projected area has been realized.

In considering further improvement of tabular grain emulsions intended for high speed photographic applications and in considering extending their advantages to moderate and slower speed photographic applications, the realization has occurred that maximizing the photographic advantages of tabular grain emulsions hinges on being able to satisfy tabular grain percent projected area and average aspect ratio requirements with the thinnest possible tabular grain population.

This realization has led to efforts to produce tabular grain emulsions containing ultrathin tabular grains. By "ultrathin" it is meant that the tabular grains have a thickness of less than 360 {111} crystal lattice planes. The spacing between adjacent {111} AgCl crystal lattice planes is 1.6 Å. Daubendiek et al U.S. Pat. Nos. 4,672,027 and 4,693,964 report the preparation of ultrathin high aspect ratio tabular grain silver bromide and silver bromoiodide emulsions.

Maskasky U.S. Pat. No. 5,217,858 (hereinafter referred to as Maskasky I) was the first to succeed in preparing a high chloride ultrathin tabular grain emulsion. This was accomplished by employing a 4,6-di(hydroamino)-5-aminopyrimidine grain growth modifier, preferably one satisfying the following formula:

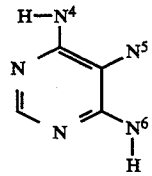

(I)

where $N^4$, $N^5$ and $N^6$ are amino moieties independently containing hydrogen or hydrocarbon substituents of from 1 to 7 carbon atoms, with the proviso that the $N^5$ amino moiety can share with each or either of $N^4$ and $N^6$ a common hydrocarbon substituent completing a five or six member heterocyclic ring. Examples of high chloride ultrathin tabular grain emulsions were provided using 4,5,6-triaminopyrimidine and adenine as representative grain growth modifiers satisfying formula I.

Maskasky U.S. Pat. No. 5,178,997 (hereinafter designated Maskasky II) discloses a process for preparing a high chloride tabular grain emulsion in which silver ion is introduced into a gelatino-peptizer dispersing medium containing a stoichiometric excess of chloride ions of less than 0.5 molar and a 7-azaindole type grain growth modifier of the formula:

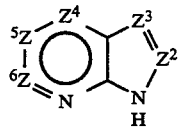

(II)

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky II contains no disclosure of high chloride ultrathin tabular grain emulsions.

Jones et al U.S. Pat. No. 5,176,991 discloses a process of chemically sensitizing high chloride tabular grain emulsions, including those prepared as taught by Maskasky I and II. Protonation of the formula I or II compound adsorbed to the grain surfaces is initiated, chemical sensitization is performed while protonation is occurring, and protonation is then terminated, so that at least a portion of the adsorbed formula I or II compound is retained on the surfaces of the sensitized grains.

SUMMARY OF THE INVENTION

In one aspect this invention is directed to a radiation sensitive emulsion containing a silver halide grain population comprised of at least 50 mole percent chloride, based on silver, in which greater than 50 percent of the total grain projected area is accounted for by ultrathin tabular grains having a thickness of less than 360 {111} crystal lattice planes and, adsorbed to the major faces of the ultrathin tabular grains, a compound of the formula:

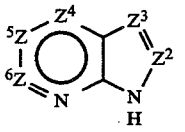

(II)

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

The present invention constitutes an improvement on the high chloride ultrathin tabular grain emulsions of Maskasky I. The 4,5,6-triaminopyrimidine grain growth modifier and morphological stabilizer, representative of the single heterocyclic ring compounds of formula I employed by Maskasky I, has been observed on further investigation to predispose the emulsions prepared in its presence to elevated minimum densities. On the other hand, adenine, representative of the fused heterocyclic ring compounds of formula I, though showing no fogging tendencies, is adsorbed so tenaciously to grain surfaces that it cannot be displaced to the full extent desired with other photographically useful adsorbed addenda, such as spectral sensitizing dyes.

At the time Maskasky I was filed high chloride ultrathin tabular grain emulsions had not been successfully prepared using 7-azaindole type, formula II, grain growth modifiers. Subsequently, as the limitations noted above of the grain growth modifiers of Maskasky I became apparent, it also became apparent that these limitations were not shared by the 7-azaindole type compounds. In other words, except for their inability to produce ultrathin tabular grain populations in high chloride emulsions, they represented a superior grain growth modifier choice. This led to further investigations and, eventually, to the discovery of the conditions of precipitation allowing 7-azaindole type grain growth modifiers to be employed in the preparation of high chloride ultrathin tabular grain emulsions.

Still later it was further discovered that the 7-azaindole type grain growth modifiers could be successfully employed in combination with either iodide or thiocyanate ion in producing high chloride ultrathin tabular grain emulsions. Neither iodide nor thiocyanate ion had been previously observed to be useful in preparing high chloride ultrathin tabular grain emulsions. For example, Maskasky II clearly teaches use of iodide or thiocyanate ion as a post nucleation grain growth modifier following nucleation in the presence of a 7-azaindole type formula II grain growth modifier, but Maskasky I notably omits this teaching, since this combination, though recognized to be useful in forming high chloride tabular grain emulsions, was not considered to afford sufficient grain thickness control to be useful in producing corresponding ultrathin tabular grain emulsions. The introduction of iodide ion and/or thiocyanate ion in the latter stages of precipitation of high chloride ultrathin tabular grain emulsions has resulted in improvements in photographic speed.

DESCRIPTION OF PREFERRED EMBODIMENTS

The invention is directed to a photographically useful, radiation sensitive emulsion containing a silver halide grain population comprised of at least 50 mole percent chloride, based on total silver forming the grain population, in which greater than 50 percent of the grain population projected area is accounted for by ultrathin tabular grains having a thickness of less than 360 {111} crystal lattice planes and a 7-azaindole type compound adsorbed to the {111} faces of the ultrathin tabular grains.

The emulsions contain a high chloride grain population. The high chloride grains contain at least 50 mole percent chloride, based on total silver forming the grain population (hereinafter referred to as total silver). The silver halide content of the grain population can consist essentially of silver chloride as the sole silver halide.

Alternatively, the grain population can consist essentially of silver bromochloride, where bromide ion accounts for up to 50 mole percent of the silver halide, based on total silver. (In naming mixed anion silver halide compositions the lowest concentration anion is named first.) In another alternative form, the silver halide forming the grain population can consist essentially of silver iodochloride, where iodide ion can be present in any concentration up to its solubility limit in silver chloride. The solubility limit of silver iodide in silver chloride is dependent on the temperature of grain precipitation. In Maskasky U.S. Pat. No. 5,288,603, here incorporated by reference (hereinafter referred to as Maskasky III), published European patent application 497,362 corresponding, a silver iodochloride emulsion is exemplified containing 22 mole percent iodide, based on silver. However, the iodide level is silver iodochloride emulsions is typically less than 10 mole percent and most commonly less than 5 mole percent, based on silver. In still another form the tabular grain population can consist essentially of silver thiocyanatochloride, Ag(SCN)Cl. Again the silver thiocyanate can be present up to its solubility limit in silver chloride. Silver thiocyanate concentrations ranging up to 2 mole percent are preferred with silver thiocyanate concentrations of less than 1 mole percent being specifically preferred. Finally, combinations of three or more anions are contemplated in the high chloride tabular grain populations. For example, silver iodobromochloride, silver bromoiodochloride, silver thiocyanatobromochloride, silver thiocyanatoiodidochloride and silver thiocyanatoiodobromochloride tabular grain populations are all contemplated. Although the inclusion of bromide ion in the high chloride tabular grain structures facilitates increasing the concentration of iodide and/or thiocyanate ions, the same preferred maximum inclusion levels of iodide and/or thiocyanate ions in silver bromide containing high chloride tabular grain structures are preferred as recited above for grains lacking bromide ion. To maximize the advantages of high chloride, it is preferred that bromide ion be present in a concentration of less than 20 mole percent, optimally less than 10 mole percent, based on total silver. Iodide ion is preferably present in a concentration of less than 2 mole percent, based on total silver. Only very small bromide and/or iodide concentrations are required to improve the properties of the grains for photographic purposes such as spectral sensitization. Significant photographic advantages can be realized with bromide or iodide concentrations as low as 0.1 mole percent, based on total silver, with minimum concentrations preferably being at least 0.5 mole percent.

At least 50 percent and preferably at least 70 percent of the projected area of the high chloride grain population is accounted for by ultrathin tabular grains. As is generally understood by those skilled in the art, tabular grains exhibit two parallel major grain faces that each lie in a {111} crystallographic plane. The grain structure lying between the {111} crystallographic planes forming the major faces of the tabular grains is also made up of a sequence of parallel {111} crystallographic planes. The {111} crystal lattice structure of the grains (which are microcrystals) is comprised of alternating {111} lattice plane layers of halide and silver ions.

For the grains to have a tabular shape it is generally accepted that the grains must contain at least two parallel twin planes. The twin planes are oriented parallel to the {111} major faces of the tabular grains. Twin plane formation and its effect on grain shape is discussed by James *The Theory of the Photographic Process*, 4th Ed., Macmillan, New York, 1977, pp. 21 and 22.

Once at least two parallel twin planes have been incorporated in a grain as it is being formed an edge geometry is formed that provides a strongly favored site for the subsequent precipitation of silver halide. This results in rapid increase in the effective circular diameter (ECD) of the tabular grains while their thickness (t) exhibits relatively little, if any, measurable increase.

To realize the art recognized advantages of at least moderate aspect ratios the average aspect ratio (ECD/t) of the tabular grains of the high chloride grain population must be at least 5. It is generally preferred that the ultrathin tabular grain population exhibit a high (>8) average aspect ratio. The tabular grains of the high chloride grain population preferably have an average aspect ratio of greater than 12 and optimally greater than 20. Average aspect ratios of the high chloride tabular grain population of up to 100 or even 200 can be achieved with average tabular grain ECDs in typical size ranges, up to about 4 μm. Since mean tabular grain ECDs of photographically useful emulsions are generally accepted to range up to 10 μm, it is apparent that still higher average aspect ratios (which can be calculated from tabular grain thicknesses provided below) are in theory possible.

A unique property of the high chloride tabular grains in the emulsions of this invention is that they are ultrathin. The ultrathin tabular grains are contemplated to have a thickness measured normal to their parallel major faces of less than 360 {111} lattice planes in all instances and, more typically less than 300 {111} lattice planes, with minimum thicknesses ranging from 120 {111} lattice planes, more typically at least 180 {111} lattice planes. Using a silver chloride {111} lattice spacing of 1.6 Å as a reference, the following correlation to grain thicknesses in μm applies:

360 lattice planes $<0.06$ μm
300 lattice planes $<0.05$ μm
180 lattice planes $<0.03$ μm
120 lattice planes $<0.02$ μm There are a number of natural propensities of high chloride emulsions in general and high chloride tabular grain emulsions in particular that must be both interdicted and reversed to achieve the combination of (a) high chloride content, (b) ultrathin tabular grains in a single grain population and (c) in preferred embodiments, at least moderate and, optimally, high average aspect ratios. When the cumulative effect of these adverse natural tendencies are considered, it is apparent why this particular combination of features was never prior to Maskasky I achieved within a single emulsion.

A. First, high chloride emulsions naturally favor the formation of grains with {100} crystal faces. Intervention during grain formation is required to achieve high chloride grains bounded by {111} crystal faces.

B. Second, even after intervention to produce {111} crystal faces, multiple twinning must be effected to achieve tabular grains. This involves a second type of intervention. In the absence of twinning silver halide grains with {111} crystal faces take the form of regular octahedra.

C. Third, twinning must be initiated very early in the preparation of the grains and with a relatively high level of efficiency to obtain tabular grains that are both ultrathin and tabular. Until at least two parallel twin planes have been introduced into a grain, the aspect ratio of the grain remains at or near 1. It is, of course, apparent that at least two parallel twin planes must be introduced into the grains before 360 {111} lattice planes have been formed. With a little reflection it is further apparent that at least two twin planes must be introduced into the grains at a very early stage of their formation to allow preferential lateral growth of the grains to a desired average aspect ratio before 360 {111} lattice planes have been formed.

D. Fourth, high chloride ultrathin grains require intervention to be maintained. A number of factors work in combination to render the high chloride grains of this invention inherently less stable than grains of other silver halide compositions. One factor is that the solubility of silver chloride is roughly two orders of magnitude higher than that of silver bromide, and the solubility of silver bromide is again roughly two orders of magnitude higher than that of silver iodide. Thus, the ripening propensity of high chloride grains is more pronounced than that of other photographic silver halide grains. A second factor stems from silver chloride naturally favoring the formation of {100} crystal faces. A third factor is that the surface to volume ratio of ultrathin tabular grains is exceptionally high. The cumulative effect is to produce a grain population having exceedingly high surface energies directed toward degradation of the ultrathin high aspect ratio grain configurations sought.

It has been discovered that high chloride ultrathin tabular grain emulsions satisfying the requirements of this invention can be achieved by improving on the process for the preparation of high chloride high aspect ratio tabular grain emulsions disclosed by Maskasky II, cited above. The Maskasky II process prepares high chloride tabular grain emulsions by introducing silver ion into a gelatino-peptizer dispersing medium containing a stoichiometric excess of chloride ions of less than 0.5 molar and a 7-azaindole type grain growth modifier.

Preferred 7-azaindole type grain growth modifiers are those satisfying the formula:

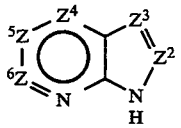

(II)

where $Z^2$ is —C($R^2$)= or —N=;
$Z^3$ is —C($R^3$)= or —N=;
$Z^4$ is —C($R^4$)= or —N=;
$Z^5$ is —C($R^5$)= or —N=;
$Z^6$ is —C($R^6$)= or —N=;
with the proviso that no more than one of $Z^4$, $Z^5$ and $Z^6$ is —N=;
$R^2$ is H, $NH_2$ or $CH_3$;
$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and
$R^6$ is H or $NH_2$.

Note that the grain growth modifiers of formula II in none of their various related forms permit a primary or secondary amino substituent $R^4$. The present invention, in fact, requires no amino substituent on the ring structure of formula II.

In preferred forms the grain growth modifiers of formula II complete a heterocyclic nucleus chosen from the group consisting of 7-azaindole; 4,7-diazaindole; 5,7-diazaindole; 6,7-diazaindole; purine; 4-azabenzimidazole; 4,7-diazabenzimidazole; 4-azabenzotriazole; 4,7-diazabenzotriazole; and 1,2,5,7-tetraazaindene.

When the grain growth modifier is chosen to have a 7-azaindole nucleus, the structure of the grain growth modifier is as shown in the following formula:

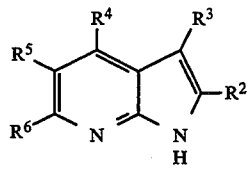

(III)

When the grain growth modifier is chosen to have a 4,7-diazaindole nucleus, the structure of the grain growth modifier is as shown in the following formula:

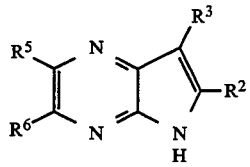

(IV)

When the grain growth modifier is chosen to have a 5,7-diazaindole nucleus, the structure of the grain growth modifier is as shown in the following formula:

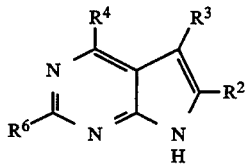

(V)

When the grain growth modifier is chosen to have a 6,7-diazaindole nucleus, the structure of the grain growth modifier is as shown in the following formula:

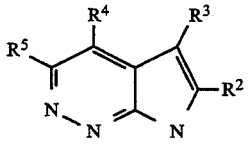

(VI)

When the grain growth modifier is chosen to have a purine nucleus, the structure of the grain growth modifier is as shown in the following formula:

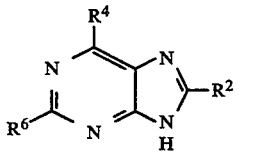

(VII)

When the grain growth modifier is chosen to have a 4-azabenzimidazole nucleus, the structure of the grain growth modifier is as shown in the following formula:

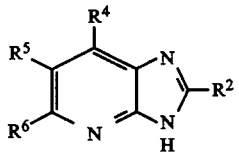

(VIII)

With the inclusion of an additional nitrogen atom to the ring structure, the 4-azabenzimidazole can become a 4,7-diazabenzimidazole of the formula:

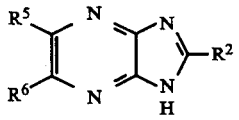

(IX)

When the grain growth modifier is chosen to have a 4-azabenzotriazole nucleus, the structure of the grain growth modifier is as shown in the following formula:

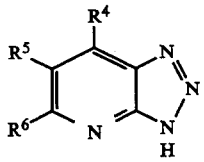

(X)

With the inclusion of an additional nitrogen atom to the ring structure, the 4-azabenzotriazole can become a 4,7-diazabenzotriazole of the formula:

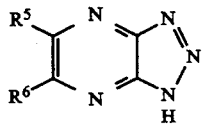

(XI)

When the grain growth modifier is chosen to have a 1,2,5,7-tetraazaindene nucleus, the structure of the grain growth modifier is as shown in the following formula:

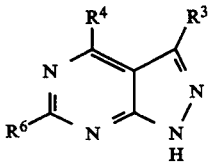

(XII)

No substituents of any type are required on the ring structures of formulae II to XII. Thus, each of $R^2$, $R^3$, $R^4$, $R^5$ and $R^6$ (hereinafter collectively referred to as $R^{2-6}$) can in each occurrence be hydrogen. In addition to hydrogen $R^{2-6}$ can include an amino substituent. When $R^2$ and $R^6$ are amino substituents, they are primary amino substituents. When $R^3$ and $R^5$ are amino substituents, they can be chosen from among primary, secondary or tertiary amino substituents. Primary amino substituents can be represented by the formula $—NH_2$; the secondary amino substituents can be represented by the formula —NHR; and the tertiary amino substituents can be represented by the formula $—NR_2$, where R in each occurrence is preferably a hydrocarbon of from 1 to 7 carbon atoms. $R^2$ can in addition include a sterically compact hydrocarbon substituent, such as methyl. $R^3$, $R^4$ and $R^5$ can independently in each occurrence additionally include halogen or hydrocarbon substituents of from 1 to 7 carbon atoms. $R^3$ and $R^5$ can additionally include a hydroxy substituent. Each hydrocarbon moiety is preferably an alkyl group—e.g., methyl, ethyl, n-propyl, i-propyl, n-butyl, i-butyl, t-butyl, etc., although other hydrocarbons, such as cyclohexyl or benzyl, are contemplated. To increase grain growth modifier solubility the hydrocarbon groups can, in turn, be substituted with polar groups, such as hydroxy, sulfonyl or amino groups, or the hydrocarbon groups can be substituted with other groups that do not materially modify their properties (e.g., a halo substituent), if desired.

Although the present invention shares with Maskasky II the selection of 7-azaindole type grain growth modifiers, the present invention employs these grain growth modifiers in much higher concentrations than contemplated by Maskasky III. Specifically, Maskasky II provides no example of 7-azaindole type grain growth modifier concentrations of greater than 9 millimoles per silver mole. Further, Maskasky II in column 11, first paragraph, clearly teaches that there are no significant advantages to be gained by employing excess levels of the grain growth modifier.

The formation of high chloride ultrathin tabular grain emulsions employing 7-azaindole type grain growth modifiers has been made possible by the discovery that 7-azaindole type grain growth modifier concentrations of at least 20 millimole per silver mole are required to achieve ultrathin grain thicknesses. It is specifically preferred that 7-azaindole type grain growth modifier concentrations of at least 30 (optimally at least 40) millimoles per silver mole be employed during precipitation. The 7-azaindole type grain growth modifier can be incorporated in any convenient higher concentration level up to or above its solubility limit in the emulsion dispersing medium. Any excess 7-azaindole grain growth modifier can be removed by emulsion washing. A preferred range of incorporation is from 20 to 200 millimoles per silver mole, most preferably from 30 to 150 millimoles per silver mole. These millimole per silver mole concentrations are based on the total silver introduced during precipitation. Hence, concentrations of the 7-azaindole grain growth modifier are not only high, but they remain high throughout precipitation. They are, for example, at the conclusion of grain growth still well in excess of that required for monomolecular coverage of 150 percent of the grain surfaces, assuming total adsorption. Once grain growth has been completed, the concentration of the 7-azaindole type grain growth modifier can be reduced by washing, but washing is not effective to remove totally the 7-azaindole type growth modifier.

In the preferred emulsion preparation an aqueous gelatino-peptizer dispersing medium is present during precipitation. Gelatino-peptizers include gelatin—e.g., alkali-treated gelatin (cattle, bone and hide gelatin) or acid-treated gelatin (pigskin gelatin) and gelatin derivatives—e.g., acetylated gelatin, phthalated gelatin, and the like.

The process of preparation is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky U.S. Pat. No. 4,713,323 (hereinafter referred to as Maskasky IV) or King et al U.S. Pat. No. 4,942,120, both here incorporated by reference.

During the precipitation of photographic silver halide emulsions there is always a slight stoichiometric excess of halide ion present. This avoids the possibility of excess silver ion being reduced to metallic silver and resulting in photographic fog. It is preferred to limit the stoichiometric excess of chloride ion in the dispersing medium to less than 0.5M, most preferably less than 0.2M and, optimally, equal to or less than 0.1M.

This contributes significantly to achieving ultrathin tabular grains. Other advantages realized by limiting the stoichiometric excess of halide ions include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent.

The 7-azaindole type grain growth modifiers are effective over a wide range of pH levels conventionally employed during the precipitation of silver halide emulsions. It is contemplated to maintain the dispersing medium within conventional pH ranges for silver halide precipitation, typically from 3 to 9, while the tabular grains are being formed, with a pH range of 4.5 to 8 being in most instances preferred. Within these pH ranges optimum performance of individual grain growth modifiers can be observed as a function of their specific structure. A strong mineral acid, such as nitric acid or sulfuric acid, or a strong mineral base, such as an alkali hydroxide or ammonium hydroxide, can be employed to adjust pH within a selected range. When a basic pH is to be maintained, ammonium hydroxide should not be used, since it has the unwanted effect of acting as a ripening agent and is known to thicken tabular grains. It is preferred to avoid the use of ripening agents.

Any convenient conventional approach of monitoring and maintaining replicable pH profiles during repeated precipitations can be employed (e.g., refer to Research Disclosure Item 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxy-methyl)aminomethane.

For tabular grains to satisfy the projected area requirement it is necessary first to induce twinning in the grains as they are being formed, since only grains having two or more parallel twin planes will assume a tabular form. Second, after twinning has occurred, it is necessary to restrain precipitation onto the major {111} crystal faces of the tabular grains, since this has the effect of thickening the grains. The 7-azaindole type grain growth modifiers employed in the practice of this invention are effective during precipitation both to induce twinning and to retrain precipitation onto the {111} major faces of the tabular grains.

It is believed that the effectiveness of the 7-azaindole grain growth modifiers to induce twinning during precipitation results from the spacing of the required nitrogen atoms in the fused five and six membered heterocyclic rings and their ability to form silver salts. This can be better appreciated by reference to the following structure:

(XIII)

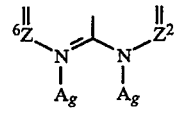

C. Cagnon et al, Inorganic Chem., 16:2469 (1977) reports a silver salt satisfying formula XIII and provides bond lengths establishing the spacing between the adjacent silver atoms of the formula. Based on the crystal structure of silver chloride as revealed by X-ray diffraction it is believed that the resulting spacing between the silver ions is much closer to the nearest permissible spacing of silver ions in next adjacent {111} silver ion crystal lattice planes separated by a twin plane than the nearest spacing of silver ions in next adjacent {111} silver ion crystal lattice planes not separated by a twin plane. Thus, when one of the silver ions shown above is positioned during precipitation in a {111} silver ion crystal lattice plane, assuming a sterically compatible location (e.g., an edge, pit or coign position) is occupied, the remaining of the silver ions shown above favors a position in the next {111} silver ion crystal lattice plane that is permitted only if twinning occurs. The remaining silver atom of the growth modifier (together with other similarly situated growth modifier silver ions) acts to seed (enhance the probability of) a twin plane being formed and growing across the {111} crystal lattice face, thereby providing a permanent crystal feature essential for tabular grain formation.

It is, of course, also important that the ring substituents next adjacent the ring nitrogen shown in formula XIII be chosen to minimize any steric hindrance that would prevent the silver ions from having ready access to the {111} crystal lattice planes as they are being formed. A further consideration is to avoid substituents to the ring positions next adjacent the ring nitrogen shown that are strongly electron withdrawing, since this creates competition between the silver ions and the adjacent ring position for the $\pi$ electrons of the nitrogen atoms. When $Z^2$ and $Z^6$ are —N= or —CH=, an optimum structure for silver ion placement in the crystal lattice exists. When $Z^2$ and $Z^6$ represent —C($R^2$)= or —C($R^6$), respectively, where $R^2$ and $R^6$ are compact substituents, as described above, twin plane formation is readily realized.

In formula XIII the —$Z^3$=, —$Z^4$= and —$Z^5$= ring positions are not shown, since, apart from being necessary to impart aromaticity, these ring positions and their substituents are not viewed as significantly influencing twin plane formation. Unlike substituents $R^2$ and $R^6$, substituents $R^3$, $R^4$ and $R^5$ are sufficiently removed from the required ring nitrogen atoms to have minimal, if any, steric influence on silver ion deposition.

The importance of employing 7-azaindole type grain growth modifiers in the early stages of grain nucleation and growth is that they are highly effective in the high concentrations identified above in inducing twinning at an early stage in precipitation. This permits an adequate population of tabular grains to be formed to satisfy projected area requirements while the grains are still in the ultrathin thickness levels. After this has been achieved the sole function that the 7-azaindole type grain growth modifier is to prevent deposition onto the {111} major faces of the tabular grains from thickening the tabular grains beyond the ultrathin limits noted above.

It is, of course, possible to utilize in combination with a 7-azaindole type growth modifier a 4,6-di(hydroamino)-5-aminopyrimidine of the type disclosed by Maskasky I—in other words, a formula I compound. To avoid the disadvantages of formula I grain growth modifiers previously noted this is not, however, preferred.

After twin plane formation has been achieved, it is possible to add to the dispersing medium any conventional grain growth modifier known to minimize precipitation onto the {111} major faces of the tabular grains, whether or not the conventional grain growth modifier is alone effective to produce an ultrathin tabular grain emulsion.

It is specifically contemplated to employ a supplemental grain growth modifier of the following structure:

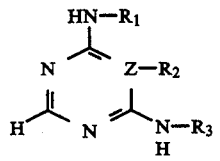

(XIV)

wherein Z is C or N; $R_1$, $R_2$ and $R_3$, which may be the same or different, are H or alkyl of 1 to 5 carbon atoms; Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together form the $—CR_4{=}N—$ linkage, $—CR_4{=}$ must be joined to Z. Grain growth modifiers of this type and conditions for their use are disclosed by Tufano et al U.S. Pat. No. 4,804,621 and Houle et al U.S. Pat. No. 5,035,992, the disclosures of which are here incorporated by reference.

Another class of supplemental grain growth modifier useful during growth under similar conditions as the grain growth modifiers of formula XV are the xanthine type grain growth modifiers of Maskasky et al U.S. Pat. Nos. 5,178,998 and 5,176,992, the disclosures of which are here incorporated by reference. These grain growth modifiers are represented by the formula:

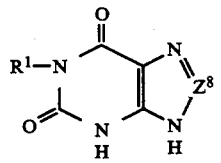

(XV)

where $Z^8$ is $—C(R8){=}$ or $—N{=}$;

$R^8$ is H, $NH_2$ or $CH_3$; and $R^1$ is hydrogen or a hydrocarbon containing from 1 to 7 carbon atoms.

Maskasky U.S. Pat. No. 4,440,463 (hereinafter referred to as Maskasky V) has taught the use of iodide ion as a grain growth modifier in the preparation of high chloride tabular grain emulsions. It is specifically contemplated to add iodide ion to the dispersing medium during tabular grain growth to supplement the effect of the 7-azaindole type compound in maintaining ultrathin tabular grain thicknesses. Effective iodide concentration levels are within the ranges for iodide inclusion previously noted. It is preferred to restrict the incorporation of iodide ion into the tabular grain structure during grain nucleation and twin plane formation and to introduce higher concentrations of iodide ion into the dispersing medium during subsequent grain growth. In one preferred form iodide is introduced abruptly (dumped) during grain growth. Alternatively the iodide ion can be introduced during a segment of grain growth. Both approaches produce a non-uniform or profiled distribution of iodide ion that contributes improvements in photographic sensitivity. These improvements extend also to emulsions with tabular grain thicknesses greater than those of ultrathin tabular grains.

Maskasky U.S. Pat. No. 5,061,617 (hereinafter referred to as Maskasky VII) has taught the use of thiocyanate ion as a grain growth modifier in the preparation of high chloride tabular grain emulsions. Thiocyanate ion addition during the preparation of high chloride ultrathin tabular grain emulsions within the concentration ranges previously stated is preferably accomplished as disclosed above for iodide ion addition with similar improvements in photographic sensitivity.

The thiocyanate or iodide ion can be introduced into the dispersing medium as any convenient soluble salt, typically an alkali or alkaline earth thiocyanate salt or as a fine ($<0.05$ μm) grain silver salt. When the dispersing medium is acidic (i.e., the pH is less than 7.0) the counter ion of the thiocyanate salt can be ammonium ion, since ammonium ion releases an ammonia ripening agent only under alkaline conditions. Thiocyanate and iodide ion additions can both be undertaken, Concurrently or sequentially.

Either single-jet or double-jet precipitation techniques can be employed in the preparation of high chloride ultrathin tabular grain emulsions according to the invention, although the latter is preferred. Grain nucleation can occur before or instantaneously following the addition of silver ion to the dispersing medium. While sustained or periodic subsequent nucleation is possible, to avoid polydispersity and reduction of tabularity, once a stable grain population has been produced in the reaction vessel, it is preferred to precipitate additional silver halide onto the existing grain population.

In one approach silver ion is first introduced into the dispersing medium as an aqueous solution, such as a silver nitrate solution, resulting in instantaneous grain nuclei formation followed immediately by addition of the growth modifier to induce twinning and tabular grain growth. Another approach is to introduce silver ion into the dispersing medium as preformed seed grains, typically as a Lippmann emulsion having an ECD of less than 0.05 μm. A small fraction of the Lippmann grains serve as deposition sites while the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048, the disclosures of which are here incorporated by reference. In still another approach, immediately following silver halide seed grain formation within or introduction into a reaction vessel, a separate step is provided to allow the initially formed grain nuclei to ripen. During the ripening step the proportion of untwinned grains can be reduced, thereby increasing the tabular grain content of the final emulsion. Also, the thickness and diameter dispersities of the final tabular grain population can be reduced by the ripening step. Ripening can be performed by stopping the flow of reactants while maintaining initial conditions within the reaction vessel or increasing the ripening rate by adjusting pH, the chloride ion concentration, and/or increasing the temperature of the dispersing medium. The pH, chloride ion concentration and grain growth modifier selections described above for precipitation can be first satisfied from the outset of silver ion precipitation or during the ripening step.

Except for the distinguishing features discussed above, precipitation according to the invention can be undertaken as taught by Maskasky II, here incorporated by reference.

EXAMPLES

The invention can be better appreciated by reference to the following examples.

Example Emulsion 1

Ultrathin AgCl Tabular Grain Emulsion

To a stirred reaction vessel containing 2 L of a solution at pH 6.0 and at 40° C. that was 2% in bone gelatin, 0.40M in NaCl was added 24 mmole of 7-azaindole dissolved in 100 mL of methanol. Then a 3.88M $AgNO_3$ solution that was also $1.2\times10^{-6}$M in $HgCl_2$ and a 4M NaCl solution were added. The $AgNO_3$ solution was added at 1.2 mL/min for 1 min, then its flow was accelerated to 10.7 mL/min in 20 min and held at this flow until 0.5 mole of silver was added. The NaCl solution was added at a similar rate but regulated to achieve and maintain a pAg of 7.63.

To the resulting emulsion was added with stirring, 2.0 mmole per Ag mole of the spectral sensitizing dye-grain stabilizer Dye A, anhydro-5-chloro-3,3'-di(3-sulfopropyl)naphtho[1,2d]thiazolothiacyanine hydroxide, tributylammonium salt dissolved in 40 mL methanol. The mixture was held with stirring for 5 min at 40° C., then phthalated gelatin and 5 L of water were added and the pH was lowered to 3.6 with $HNO_3$ to precipitate the emulsion. The precipitate with 5 L of added distilled water was adjusted to pH 5.6. The resulting suspension was precipitated a second time at pH 3.6. The solid phase was resuspended with a 1% gelatin solution that was 4.3 mmolar in NaCl. The final pH was adjusted to 5.5.

The resulting tabular grain AgCl emulsion had an average equivalent circular grain diameter of 1.6 μm, an average thickness of 0.042 μm, an average aspect ratio of 38, and 90% of the grains were tabular based on total grain projected area. From edge-on and face-on grain views obtained by scanning electron microscopy, it was found that 84% of the tabular grain population projected area was accounted for by ultrathin tabular grains having a thickness of less than 360 {111} crystal lattice planes and an average aspect ratio of greater than 8.

Example Emulsion 2

Ultrathin AgICl (0.5 mole % Iodide) Tabular Grain Emulsion

To a stirred reaction vessel containing 2 L of a solution at pH 6.0 and at 40° C. that was 2% in bone gelatin, 0.040M in NaCl was added 24 mmole of 7-azaindole dissolved in 100 mL of methanol. Then a 3.88M $AgNO_3$ solution that was also $1.2\times10^{-6}$M in $HgCl_2$ and a 4M NaCl solution were added. The $AgNO_3$ solution was added at 1.2 mL/min for 1 min, then its flow was accelerated to 10.7 mL/min in 20 min and then stopped. A total of 0.46 mole of silver was added. The NaCl solution was added at a similar rate but regulated to achieve and maintain a pAg of 7.63. The NaCl solution was replaced with one that was 0.27M NaI and 3.7M NaCl. The precipitation was continued until a total of 0.5 mole of silver was added.

The emulsion was spectrally sensitized and washed similarly to that of Example Emulsion 1. The washed tabular grain AgICl emulsion had an average equivalent circular grain diameter of 1.6 μm, an average thickness of 0.037 μm, an average aspect ratio of 43, and 90% of the grains were tabular based on projected area. From edge-on and face-on grain views obtained by scanning electron microscopy, it was found that 90% of the tabular grain population projected area was accounted for by ultrathin tabular grains having a thickness of less than 360 {111} crystal lattice planes and an average aspect ratio of greater than 8.

Example Emulsion 3

Ultrathin Ag(SCN)Cl (0.25 mole % SCN) Tabular Grain Emulsion

To a stirred reaction vessel containing 2 L of a solution at pH 6.0 and at 40° C. that was 2% in bone gelatin, 0.040M in NaCl was added 24 mmole of 7-azaindole dissolved in 100 mL of methanol. Then a 3.88M $AgNO_3$ solution that was also $1.2\times10^{-6}$M in $HgCl_2$ and a 4M NaCl solution were added. The $AgNO_3$ solution was added at 1.2 mL/min for 1 min, then its flow was accelerated to 6.0 mL/min in 10 min and then stopped. A total of 0.14 mole of silver was added. The NaCl solution was added at a similar rate but regulated to achieve and maintain a pAg of 7.63. The NaCl solution was replaced with one that was 13.8 mM in NaSCN and 3.98M in NaCl. Then the addition of the $AgNO_3$ solution was continued with accelerated flow from 6.0 mL/min to 10.7 mL/min and then held constant until a total of 0.5 mole of silver was added while maintaining a constant pAg of 7.63.

The emulsion was spectrally sensitized and washed similarly as Example Emulsion 1. The resulting washed tabular grain Ag(SCN)Cl emulsion had an average equivalent circular grain diameter of 1.4 μm, an average thickness of 0.043 μm, an average aspect ratio of 33, and 90% of the grains were tabular based on projected area. From edge-on and face-on grain views obtained by scanning electron microscopy, it was found that 79% of the tabular grain population projected area was accounted for by ultra-thin tabular grains having a thickness of less than 360 {111} crystal lattice planes and an average aspect ratio of greater than 8.

Control Emulsion 4

AgBrCl Cube Emulsion

This emulsion consisted of 0.6 μm AgBrCl cubes (0.5 mole % Br) that was chemically sensitized and spectrally sensitized with Dye A.

Photographic Results

Example Emulsions 1 and 2, and Control Emulsion 4 were chemically sensitized with NaSCN, sulfur sensitizer, and gold sensitizer. Example Emulsion 3 was chemically sensitized with sulfur and gold sensitizer. The antifoggant 1-(3-acetamidophenyl)-5-mercaptotetrazole was added prior to coating. Examination of Emulsions 1, 2 and 3 after sensitization by optical microscopy confirmed that they still consisted of high aspect ratio and ultrathin tabular grains.

The sensitized emulsions were coated on a cellulose acetate photographic film support with an antihalation backing to make color photographic coatings. The coatings contained the following: 0.65 g Ag per $m^2$, 1.9 g yellow dye-forming coupler per $m^2$, 4.2 gelatin per $m^2$, surfactant, and hardener.

The coatings were exposed for 0.1 sec to a tungsten light source through a Wratten TM 2B filter (to block exposure to the spectral region of native grain sensitivity) and a 0–4.0 neutral density step-tablet. The exposed coatings were photographically processed using Kodak C-41 Flexicolor color negative processing chemistry at a 3 min 15 sec. development time. The results are given in Table I.

TABLE I

| Coating/ Emulsion | Relative Speed | Granularity[a] | Relative Speed Normalized for Equal Granularity |
|---|---|---|---|
| Example 1 | 81 | 0.031 | 214 |
| Example 2 | 96 | 0.027 | 316 |
| Example 3 | 79 | 0.027 | 275 |
| Control 4 | 100 | 0.050 | 100 |

[a]Measured at one-half image density

As can be seen in Table I, Control Emulsion 4 gave inferior photographic performance compared to the ultra-thin tabular grain emulsions. The best performance was obtained from the ultrathin AgICl tabular grain emulsion with nonuniform iodide, Example Emulsion 2.

The invention has been described in detail with particular reference to preferred embodiments thereof, but it will be understood that variations and modifications can be effected within the spirit and scope of the invention.

What is claimed is:

1. A radiation sensitive emulsion containing a silver halide grain population comprised of at least 50 mole percent chloride, based on silver, in which greater than 50 percent of the total grain projected area is accounted for by ultrathin tabular grains having a thickness of less than 360 {111} crystal lattice planes and, adsorbed to the major faces of the ultrathin tabular grains and present in a concentration in excess of that required to provide monomolecular coverage of an area equal to 150 percent of the area of the grain surfaces, a compound of the formula:

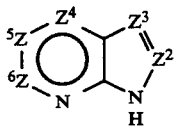

(II)

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

2. A radiation sensitive emulsion according to claim 1 wherein the ultrathin tabular grains account for at least 70 percent of the grain population projected area.

3. A radiation sensitive emulsion according to claim 1 wherein the ultrathin tabular grains accounting for at least 50 percent of the grain population projected area have a thickness of less than 300 {111} lattice planes.

4. A radiation sensitive emulsion according to claim 1 wherein $Z^2$, $Z^3$, $Z^4$, $Z^5$ and $Z^6$ complete a heterocyclic nucleus chosen from the group consisting of 7-azaindole; 4,7-diazaindole; 5,7-diazaindole; 6,7-diazaindole; purine; 4-azabenzimidazole; 4,7-diazabenzimidazole; 4-azabenzotriazole; 4,7-diazabenzotriazole; and 1,2,5,7-tetraazaindene.

5. A radiation sensitive emulsion according to claim 4 wherein the grain growth modifier satisfies the formula:

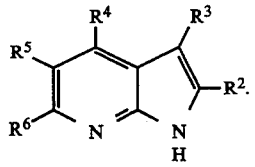

6. A radiation sensitive emulsion according to claim 1 wherein the ultrathin tabular grains accounting for at least 50 percent of the grain population projected area have a thickness of at least 120 {111} lattice planes.

7. A radiation sensitive emulsion according to claim 1 wherein the ultrathin tabular grains account for at least 70 percent of the grain population projected area, have a thickness in the range of from 180 to 300 {111} lattice planes, and contain less than 2 mole percent iodide and contain less than 20 mole percent bromide, based on silver.

8. A radiation sensitive emulsion according to claim 1 wherein the ultrathin tabular grains contain at least one of bromide, iodide and thiocyanate ions.

9. A radiation sensitive emulsion according to claim 8 wherein the ultrathin tabular grains contain at least one of (a) bromide ion in a concentration of up to 20 mole percent, (b) iodide ion in a concentration of up to 10 mole percent, and (c) thiocyanate ion in a concentration of up to 2 mole percent.

10. A radiation sensitive emulsion according to claim 9 wherein the ultrathin tabular grains contain at least 0.5 mole percent iodide or bromide.

11. A radiation sensitive emulsion according to claim 1 wherein the ultrathin tabular grains consist essentially of silver chloride.

12. A radiation sensitive emulsion containing a silver halide grain population comprised of at least 50 mole percent chloride, based on silver, in which greater than 50 percent of the total grain projected area is accounted for by ultrathin tabular grains having a thickness of less than 360 {111} crystal lattice planes and, adsorbed to the major faces of the ultrathin tabular grains and present in a concentration of from 20 to 200 millimoles per silver mole, a compound of the formula:

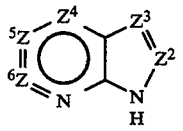

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

13. A radiation sensitive emulsion according to claim 12 wherein the compound of formula II is present in a concentration of from 30 to 150 millimoles per silver mole.

* * * * *